US006419569B1

(12) United States Patent
Frech et al.

(10) Patent No.: US 6,419,569 B1
(45) Date of Patent: Jul. 16, 2002

(54) HAND-HELD BELT SANDER

(75) Inventors: Alfred Frech, Leinfelden-Echterdingern; Gerd Berner, Stuttgart; Reiner Silberer, Rutesheim; Michael Behrendes, Neuthard; Michael A Gabold, Leinfelden-Echterdingen; Joachim Schadow, Stuttgart; Rudolf Fuchs, Neuhausen; Sinisa Andrasic, Fiderstadt; Thomas Palaver, Filderstadt, all of (DE); Juergen Koellner, Selzach (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/670,729

(22) Filed: Sep. 27, 2000

Related U.S. Application Data

(62) Division of application No. 09/013,351, filed on Jan. 26, 1998, now Pat. No. 6,174,226.

(30) Foreign Application Priority Data

Feb. 7, 1997 (DE) ..... 197 04 086

(51) Int. Cl.[7] ..... B24B 23/06
(52) U.S. Cl. ..... 451/355; 451/303
(58) Field of Search ..... 451/355, 296, 451/489, 303

(56) References Cited

U.S. PATENT DOCUMENTS 2,178,865 A * 11/1939 Swan ..... 451/355
3,334,447 A * 8/1967 Leveque ..... 451/303
3,427,757 A * 2/1969 Redman ..... 451/355
3,619,949 A * 11/1971 Welsch et al. ..... 451/355
5,210,981 A * 5/1993 Urda ..... 451/355

OTHER PUBLICATIONS

Model 55–L Dynafile Brochure, Dynabrade, Inc. 5–1977(copy in 451/355).*

* cited by examiner

*Primary Examiner*—Robert A. Rose
(74) *Attorney, Agent, or Firm*—Michael J. Striker

(57) ABSTRACT

A hand-held belt sander has a housing, an on-off switch and a power supply conductor supported by the housing, a motor and a transmission received in the housing, a sanding belt, a driving roller driven by the motor and driving the sanding belt, a sliding shoe provided with a base, a deviating roller arranged so that said sanding belt is guidable over the deviating roller and the base of the sliding shoe, a unit for centering the sanding belt, a unit for clamping the sanding belt, the deviating roller and the driving roller have different diameters so that the sanding belt is guided inclinedly, the housing being elongated and the sanding belt being guided on guiding parts which are introduced in a rear region of the elongated housing so that with together with the sanding belt in a front region of the elongated housing a centrally forwardly extending, freely projecting, wedge tip-shaped contour is formed so that the hand-held belt sander as a whole has a lance-like contour.

23 Claims, 10 Drawing Sheets

HAND-HELD BELT SANDER

This application is a divisional of Ser. No. 09/013,351 filed Jan. 26, 1998, now U.S. Pat. No. 6,174,226.

BACKGROUND OF THE INVENTION

The present invention relates to a hand-held belt sander.

Hand-held belt sanders are known in the art. One of such hand held belt sanders is disclosed in the U.S. Pat. No. 4,694,616. It is provided with a driving roller and two deviating rollers having a substantially corresponding diameter. They guide the sanding belt over a sanding base exchangeably arranged on the device. With this device small surfaces of various profiles can be well treated. However, because of the relatively great diameter of the driving and deviating rollers of the hand-held belt sander and because of the coinciding tangential transmission between the rollers and the sanding base, corners and hollow channels are not sufficiently accessible.

The German patent document DE 02 42 26 708 discloses a stationary belt sanding machine with a sanding belt guided over at least two rollers and having a small sanding base. It is provided for sanding works, in which work pieces are to be treated only directly over the sanding belt surface in the embracing region of the rollers, in particular for the production of concave surfaces.

The German patent document DE 0S 39 19 651 discloses a handheld belt sander which in addition to the conventional substantially identical deviating and driving rollers, has a small additional deviating roller for guiding the sanding band tangentially coincidentally between the deviating roller and the sanding base. With this device, corners and hollow channels are substantially better accessible than with other handheld sanders. Since however its construction is based on the conventional handheld belt sander, its belt centering and belt tensioning can be performed in expensive way because of additional, small deviating roller.

Furthermore, the British patent document GB 962 164 discloses a handheld belt sander with the driving roller provided on its periphery with longitudinal grooves. Therefore an improved for transmission to the sanding band is obtained. The handheld belt sander is however heavy, uncomfortable, and complicated.

In the known handheld belt sanders the belt centering is performed by turning or tilting of the deviating rollers which rotate on roller or metal sliding bearings about a fixed rotary point on the roller axis. The deviating roller is mounted by screwing or safety rings on its axle. An exchange of the deviating roller is complicated. Moreover, in the known belt sanding devices the sanding band is tensioned by displacement of an operating lever which is operative for actuating the deviating rollers at the outer side of the sanding belt. However, the operating lever is difficult to axis and not easy to operate.

In belt sanders, independently from their size of the width of the belt, the sanding belt is driven through a rotatable driving roller by a frictional connection. Therefore, the force transmitted to the belt is dependent on the friction value between the inner side of the belt and the roller, as well as on the normal force of the belt on the roller, and on the embracing angle. However, in the known belt sanders these values are not sufficient.

SUMMARY OF THE INVENTION

Accordingly, it is an object of present invention to provide a handheld belt sander which avoids the disadvantages of the prior art.

In keeping with these objects and with others which will become apparent hereinafter, one feature of present invention resides, briefly stated, in a hand-held belt sander which has a lance-shaped contour, and in which the parts which guide the sanding band are guidingly introduced in a rear region of an elongated housing so that, together with the sanding belt they form in the front region of the housing a centrally forwardly extending, freely projecting wedge-tip shaped contour.

When the hand-held belt sander is designed in accordance with present invention, it has better handling, simplified mechanical system for manual adjustment of a belt centering, as well as is favorable as to the number of individual parts, the manufacture and mounting.

In accordance with another feature of present invention, a fork which receives the deviating roller and which is used for adjustment of the belt running can be exchangeable by a user without dismounting the parts of the device.

A further advantage of the present invention is that the belt running is centerable with a handle which surrounds the roller axis of the deviating roller at both sides and is supported in a sliding member so that it is joined through a virtual three point structure and is tiltable around it with an adjusting screw. The legs of the handle are formed as flat springs which by the screw force both fix the roller and also are used for a special position of the sliding block. The handle is supported at the rear end centrally in the sliding member, so that no high moments are produced in the lever. The small deviating rollers which are arranged in pairs near one another for the belt are composed of high-strength synthetic plastic and run with self lubrication and without additional roller or sliding bearings directly on the roller axle. A substantially simplified mounting, lower number of components, and low cost, as well as a simpler subsequent change of the deviating rollers is characteristic for the inventive solution when compared with the known solutions.

A special advantage of the inventive hand-held belt sander is that the sanding belt can be easily exchangeable by unlocking of both clamping rollers with a single lever which is easily operable and arranged outside of the device. The both clamping rollers are supported so that they are elastically coupled with one another to be outwardly radially expandable. In the locked position this provides for the elastic sufficient belt clamping. The adherence of the sanding dust is prevented by the clamping rollers. The clamping lever is designed so that both in the blocked and in the unblocked position it engages in a simple manner without additional components for arresting its rotary axle.

A further advantage is that a fixed base plate of the belt clamping mechanism and the sanding shoe, as well as other parts are held premountable before the mounting in the ridge-like manner. In addition, the base plate which works as a supporting cover has further functions such that the receipt of the roller bearing of the drive shaft which carries the driving roller and the receipt end positioning of the buffer disk. The bearing support is formed as a simple punched part for all multiple functions. Since its mounting is performed without additional parts between the sliding shoe and the housing shell, only a few individual components are and the mounting is simplified. A further advantage of the invention is that the frictional connection of the driving roller relative to the sanding belt is increased by combining the running surface of the driving roller from hard and soft material and applying grain material on the running surface, or it is provided with brushes and the normal force between the sanding belt and the driving roller is increased by forming grooves in the running layer, so that inclined small plates are formed which are placed under load and thereby increase in diameter of the roller. Furthermore, the application of a skin-like coating has the advantage that under load it rises, and an additional pressing roller is arranged, so that with no raising the clamping force of the belt is needed and the sanding belt can be finally operated.

It is also advantageous to provide a form-locking connection between the belt and the roller, by combining a perforated belt with a roller provided with pins or by profiling the lower side of the belt and the roller so that a form-locking connection is produced during roller of this parts over one another. In corresponding variants, the advantage of a form-locking drive is provided by a transmitting correspondingly high forces with relatively low belt clamping.

Therefore the sanding shoe, the drive cover, the housing and the means for belt clamping are provided with inventive features, and the sanding shoe and the drive cover form an important component of a replacement part, on which a differently equipped sanding belts or the like can be arranged.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is an explosion view while

DESCRIPTION OF PREFERRED EMBODIMENTS

Figure 1:
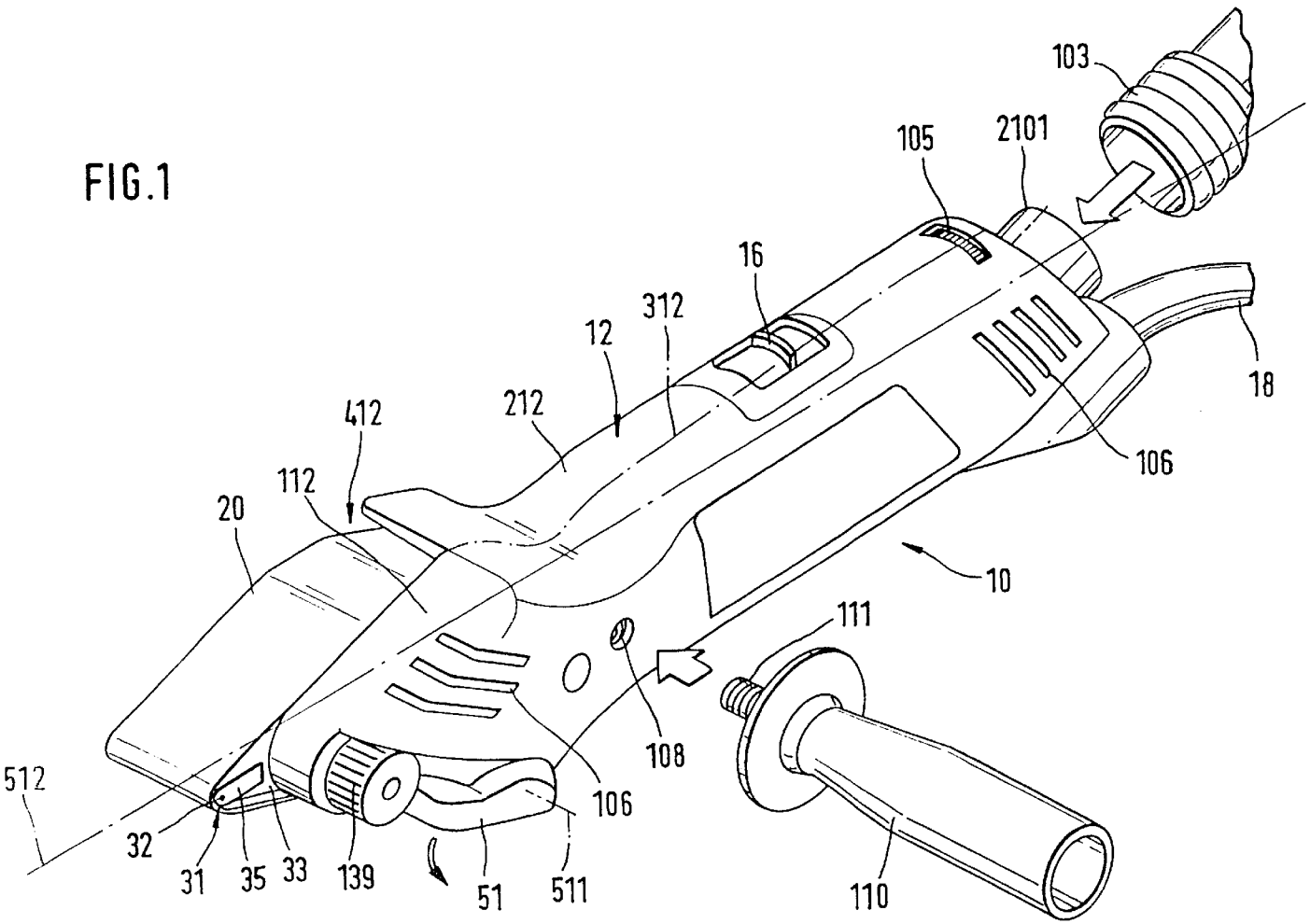
FIG. 1 is a spacial view of a hand-held belt sander in accordance with one embodiment of the present invention.

A hand-held belt sander 10 shown in FIG. 1 has a slim, lance-shaped construction with forward wedge-shaped and approximately tip-shaped working surfaces of a sanding band 20. Its housing 12 extends directly rearwardly for receiving a transmission 15 and a motor 14 shown in FIG. 3. The elongated, rod-shaped housing 12 includes a longer and a shorter shells 112, 212, which are connected with one another through a central abutment joint 312.

An on-off switch 16 is arranged in the rear region of the housing 12 for turning on the motor for rotating the sanding belt 20. An electric cable 18 extends from the rear end of the housing 12. Near it a suction 2101 of the suction passage 101 shown in FIG. 3 near an adjusting gear 105 of an electronic rotary speed preselecting device. Lateral ventilation slots 106 are provided in the rear and the front region of the housing 12. The shorter shell 212 forms relative to the longer shell 112 a recess 412 in the wedge-shaped, front region of the housing 12. A sanding belt 20 is guided in the recess 4102 so that it substantially coincides with the contour of the elongated shell 112 as seen in the lateral direction.

Figure 3:
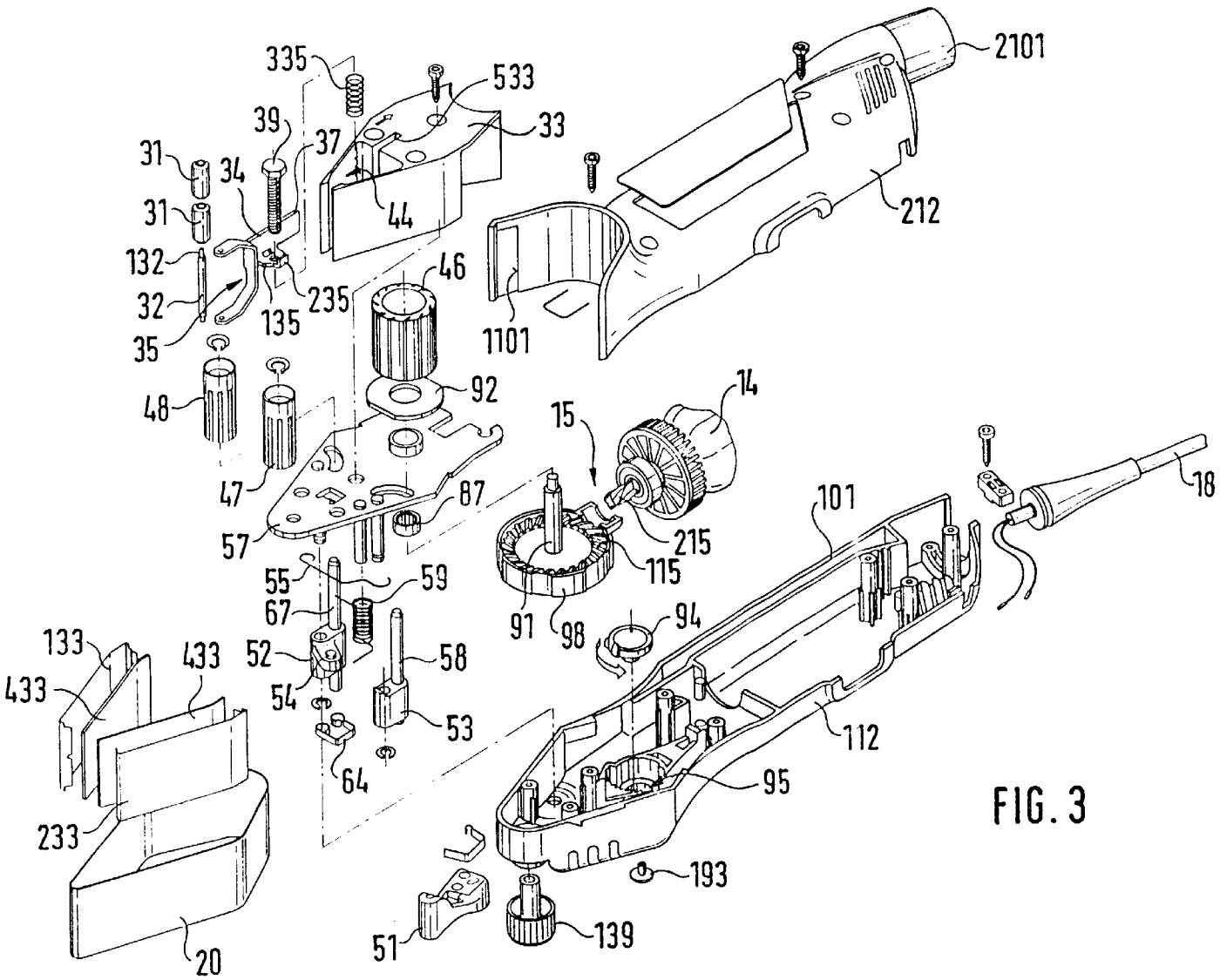
FIG. 3 is an explosion view of the inventive hand-held belt sander.

The sanding belt 20 is supported by a sliding shoe 33 shown in FIG. 3. The sliding shoe is wedge-shaped and has a tip 333 extending forwardly. The sliding shoe 33 is provided on its edge surfaces with two sanding bases 133, 233. The sliding shoe in front of its tip 333 carries on a handle 33 with the fork 35, a pair of deviating rollers 31. The deviating rollers pair 31 is rotatably supported in the fork 35 through an axial 32 as shown in FIG. 3. At the opposite side of the deviating roller pair 31, the sanding belt 20 is guided over a driving roller 46 shown in FIG. 3. A housing axis 510 identified in a dot-dash line illustrates the longitudinal extension of the hand-held belt sander 10.

A turning button 139 for adjusting a centering position of the sanding belt 20 is arranged in the front region of the longer housing shell 112. It projects laterally and is integrated by arrangement in an indentation flush in the housing contour. During turning of the button 132 the fork 35 with the axial 32 and the handle 34 which carries the deviating rollers 31 is turned, depending on a rotary direction, in one or another direction.

Closely near the turning button 139, the hand-held belt sander 10 carries a clamping and releasing lever 51 which projects laterally and is also integrated in the housing contour by arrangement in an indentation and flush with it. During turning of the clamping and releasing lever 51 about its axis 511, the sanding belt 20 is released for exchange.

A suction hose 103 is connectable to the suction pipe 2101. The suction hose is connected with an external, not shown dust aspirating device for aspiration of sanding dust.

An auxiliary handle 110 with its threaded piece 111 is screwable into a threaded opening 108 in the front region of the longer shell 112 of the housing 12. Thereby the hand-held belt sander 10 can be adjustable in an especially fine and controllable manner.

Figure 2:
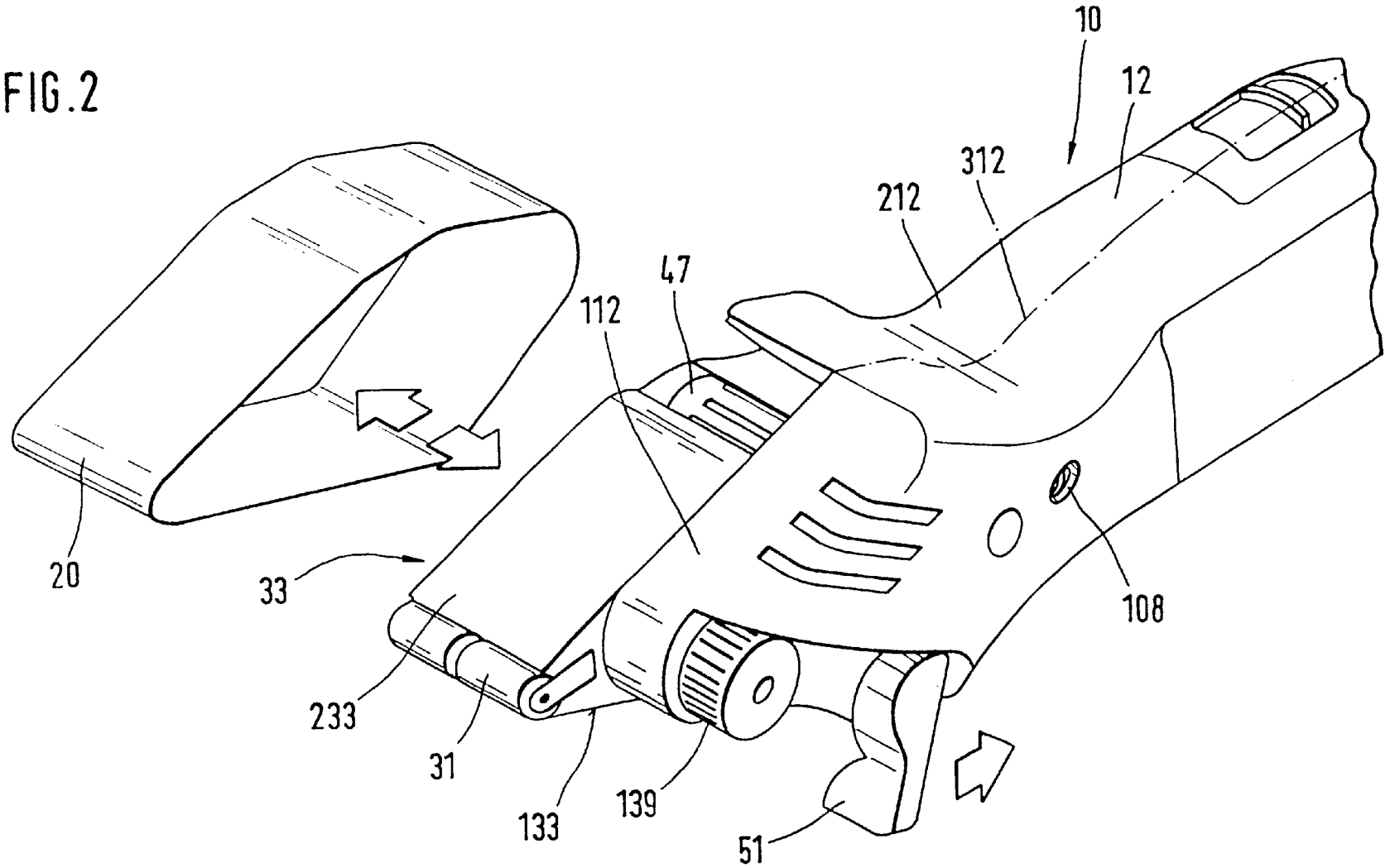
FIG. 2 is a spacial, partially exploded view of a front region of the inventive hand-held belt sander with a released sanding belt.

FIG. 2 shows the hand-held belt sander 10 with a dismounted sanding belt 20 and the clamping lever 51 located in its releasing position in which it is turned downwardly. The deviating rollers 31 which are arranged in pair, the sliding shoe 33 together with the sanding bases 133, 223 and the radially inwardly turned clamping roller 47 can be clearly seen from this Figure.

FIG. 3 shows a hand-held belt sander 10 in an explosion view. Its construction, its components and its operation can be easily recognizable. These figures specifically shows the housing 12 assembled of the longer and shorter shells 112, 212 and forming a recess for 112 in the front region in view of their length difference.

A small pinion 215 which is not shown in detail supports a roller bearing and axially following impeller, and a partially shown roller of the motor 14 is connected to it. The small pinion 21 engages with the plate gear 115 of the transmission 15, which is surrounded by a lubricant 1098 and is centrally fixably connected with a driven shaft 91. The species 16 is held between the shelves 112, 212. The E-connecting cable 18 extending outwardly of the housing 12 is also held between the shells.

The sanding belt 20 can be seen at the left side in the observation direction, and the sanding basis 133, 223 with the felt plates 43 arranged under them are located above the sanding belt. The deviating roller pair 31 with their axial 32 which carries at its ends pins 132 are shown above at the left side. Furthermore, the sliding shoe 33 with its tip 333 follows the handle 34 with the fork 35 at the right side. Its opening 44 merging into slot 533 and bore hose 331 332 can be easily seen in this Figure. The fork 34 in the mounted condition surrounds the sliding shoe 33 in a springy gap-free manner.

The handle 34 carries a bent tab 235 with an opening 135 for passage of an adjustment screw 39. It is supported by spring 335 on the bottom of the opening 44. The screw 39 is adjustable by an adjusting button 139 and operates for turning the handle 34 together with the deviating rollers 31 for centering of the belt running.

Figure 10:
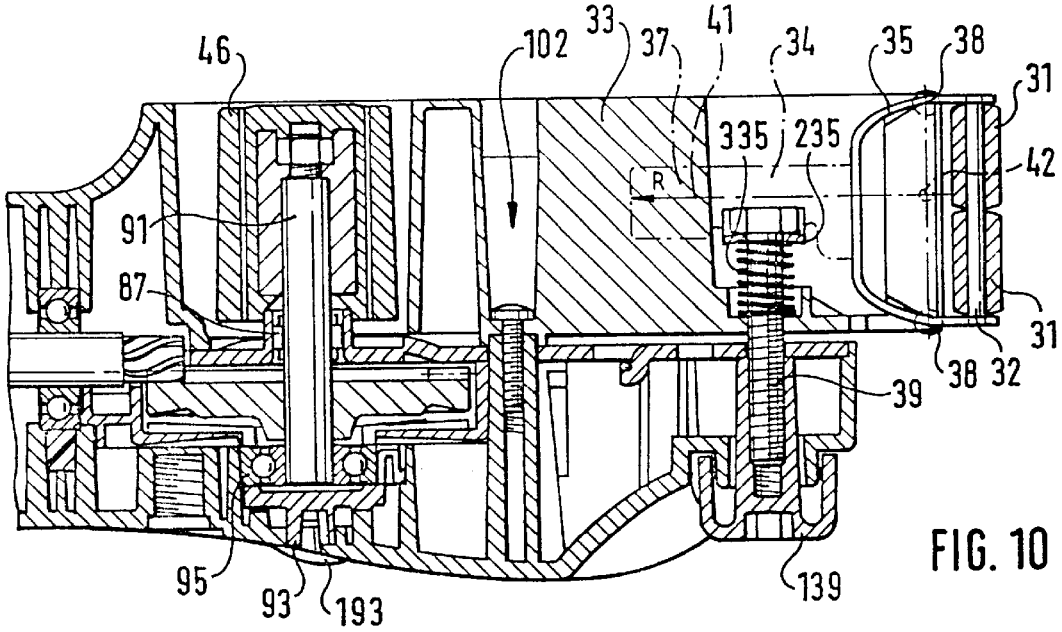
FIG. 10 is a view showing a longitudinal section of the front region of the hand-held belt sander.

The design and the operation of the rear end 37 of the handle 34 is illustrated in FIG. 10. This Figure also shows radii 38, 41 in the groove button 40 of the slot 533 for guiding the fork 35, which form a virtual rotary point 42 for the handle 44.

Figure 4:
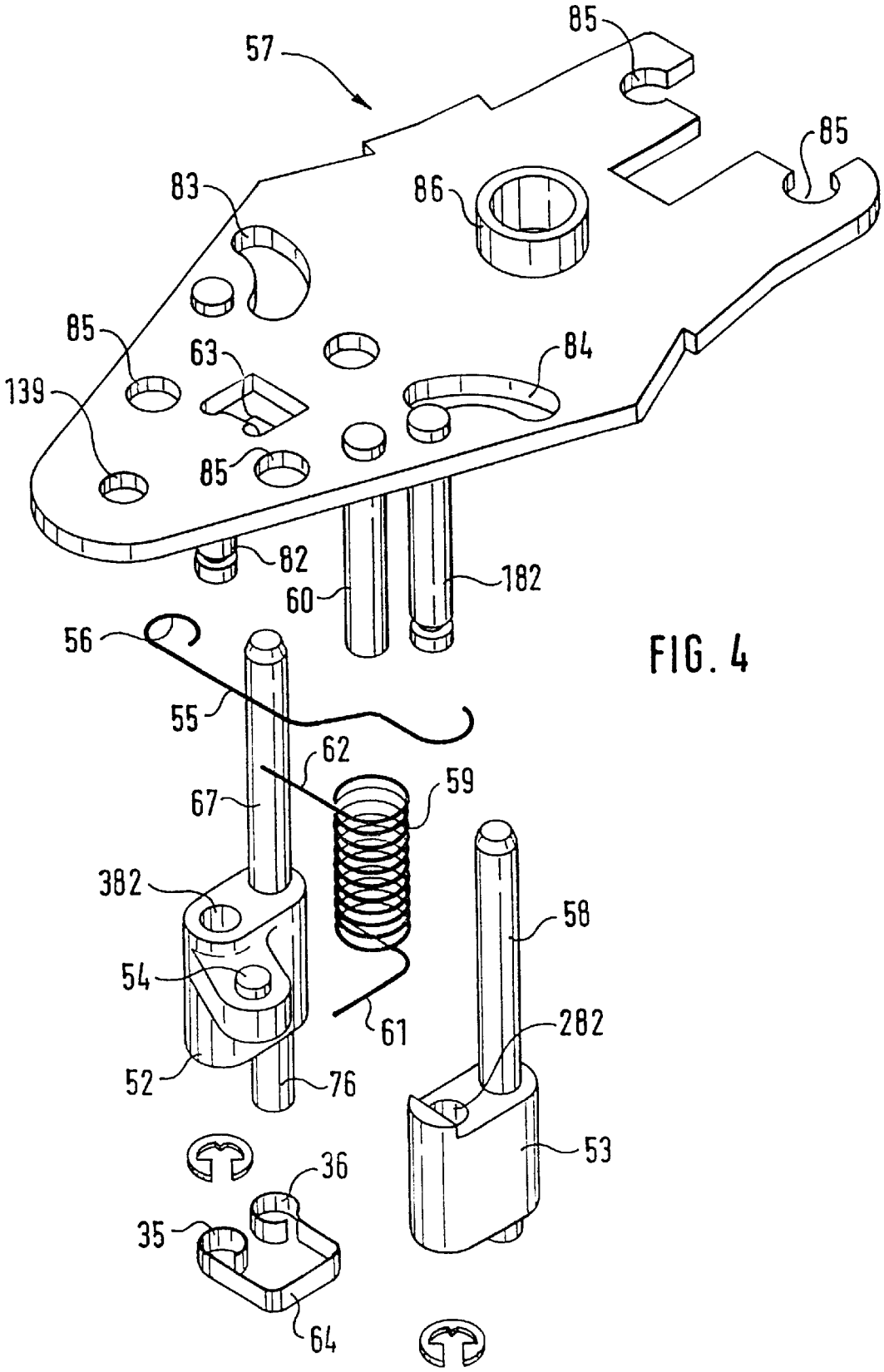
Figure 5:
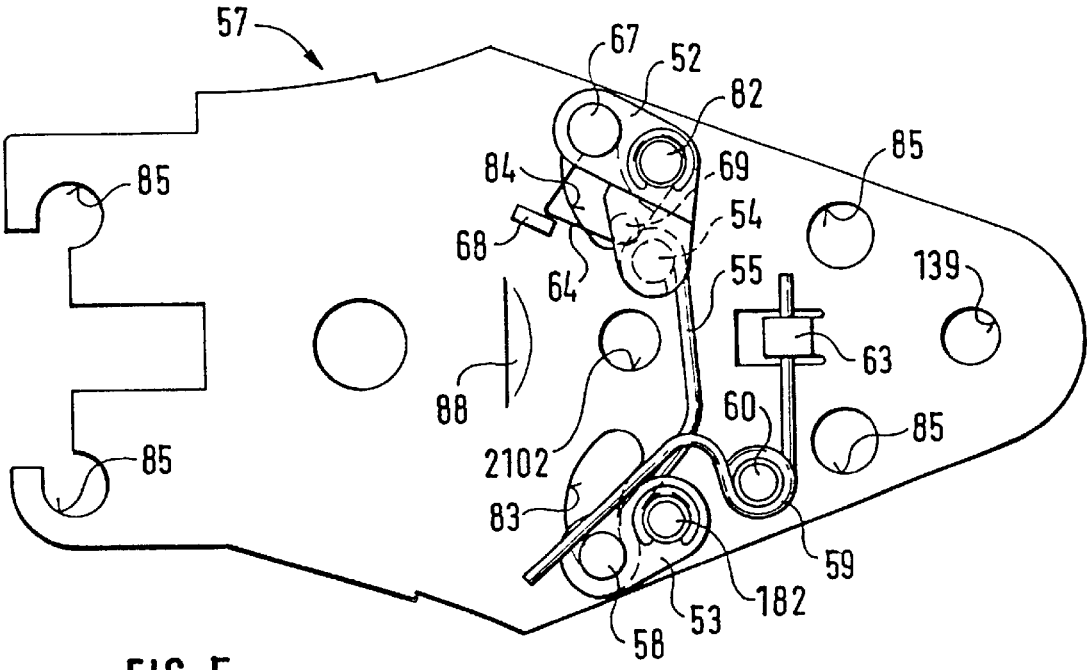
FIGS. 5–8 are side views of a transmission cover and a belt clamping axial.
Figure 6:
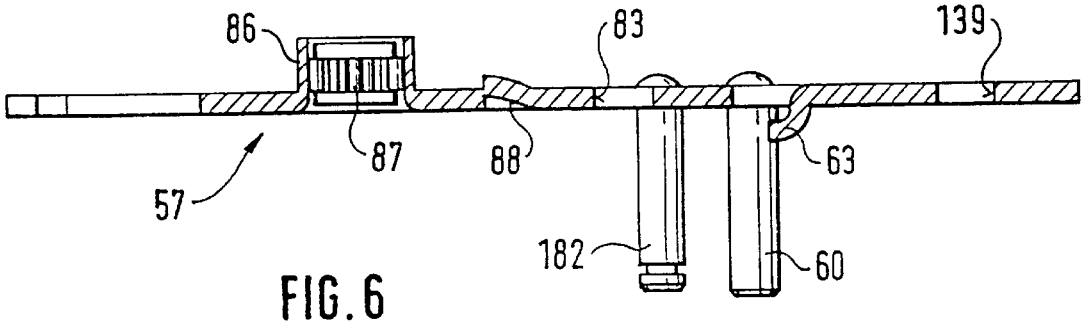
Figure 7:
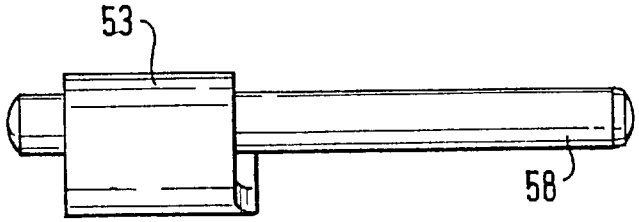
Figure 8:
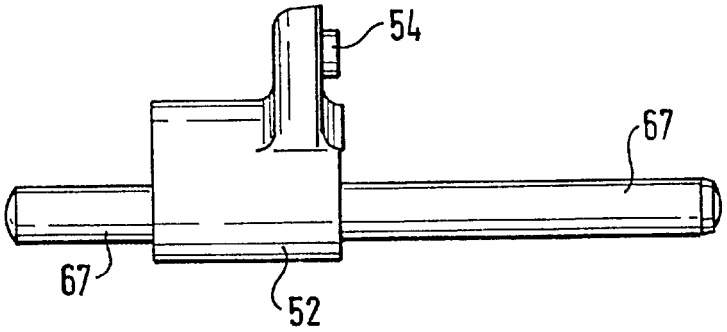

The driving roller 46 shown in the upper, central region in FIGS. 3 and 4 has small plates 146 which are separated from one another by inclined slots 246. Belt clamping rollers 47, 48 composed of synthetic plastic material are shown at the left side. By turning of the supporting lever 52, 53 they are movable readily inwardly by means of the clamping and releasing lever 51 for exchanging the sanding belt 20.

FIGS. 5–12 show the operation of the components illustrated in FIGS. 3 and 4. They include a plug 54 which projects on a lateral arm of the supporting lever 52 axis-parallel with it, a spring wire 55, the transmission cover 57, the torsion spring 59, the pin 60 with the end 61, 62, a release 63 in the transmission cover 57, a U-shaped clamping spring 64 with ears 65, 66, a reap 68, an axial plug 69, a longitudinal opening 70, a flat spring 71 in the clamping-releasing lever 51, its ends 72, 75, grooves 73, 74, an axial 76 of the clamping-releasing lever 51, a slot 77 in the axial 76 of the clamping-releasing lever 51, a longitudinal cortigation 78 in the flat spring 71, transverse grooves 79 in the belt clamping rollers 47, 48, a pin 82 on the transmission cover 57 which forms the axis of the bearing lever 52, a pin 182 which forms an axis for the bearing lever 53, openings 282, 382 in the bearing levers 53, 52, a circular-arc-shaped punch out 83 in the transmission cover, openings 85 a collar 86, a needle bearing 87 for the driven shaft 91, the release 88, claws 89 forming an axial securing feature for the disk 22 of ceramic, a housing plug 90, a profiled plug 93 of the adjusting plate 94 for the transmission gap adjustment, a plug 193 for floating the profiled plug 93, a fixed bearing 95, an arresting projection 96, axial grooves 97, a lubricant pen 98, an outer wall 99 of the housing, a ring wedge 1 housing, a suction opening 1101 of the dust aspiration passage 101, a suction pipe 2101 a threaded opening 102 in the sliding shoe 33 for an engagement of a holding screw of an underframe for mounting on the sliding shoe, both openings 1102 in the sliding shoe 33 for engaging of the plug of a not shown underframe for a stationary arrangement of the hand-held belt center 10.

Figure 11:
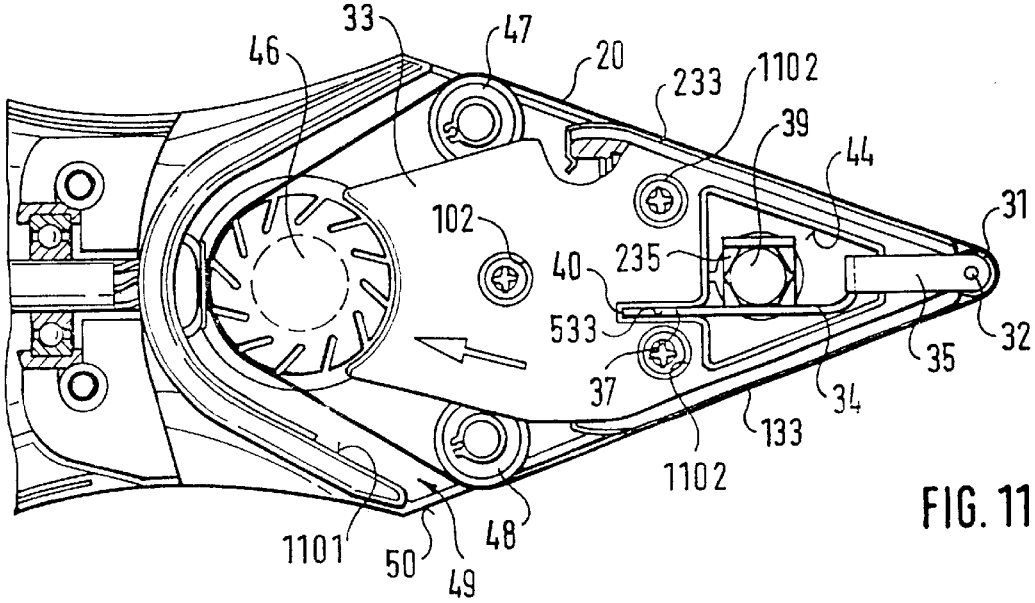
FIG. 11 is a view of the front region of the hand-held belt sander from the side of the free sanding belt side.

As can be seen from FIGS. 5–8, bearing levers 52, 53 are provided for mounting the rollers 47, 48. The rollers can turn on the bearing levers over a circular path radially inwardly. The rollers 47, 48 are turned inwardly as shown in FIGS. 2, 11, for a belt exchange. In the operational position the roller 48 is mechanically arrested in its outer position, while the other roller 47 is pressed outwardly by a spring 59. The fixedly arrested roller 48 abuts against a side of the sander, on which the sanding band 20 is inserted in the housing 12. Thereby, independently on the belt length, a constant inlet gap 49 of less 6 mm between the running in belt 20 and the housing edge 50 is guaranteed for safety reasons. Thicker sanding bands lead however to smaller gaps. Both rollers 47, 48 or bearing levers 52, 53 are simultaneously actuated through a clamping/releasing lever 51 arranged outwardly on the housing 12. For this purpose the bearing lever 52 which actuated directly through the clamping-releasing lever 51 is connected through an axial plug 54 on which a spring-wire piece 56 with an ear 56 is mounted as shown in FIG. 4. A sliding down of the wire 55 from the plug 54 is prevented since the free end of the plug 54 after mounting of the lever 52 ends directly over the upper surface of the bearing cover 57. The other end of the wire 55 is mounted in the same way on the other bearing lever 53. The engaging points 54, 58 of the wire ends at both bearing levers 52, 53 are selected so that during turning of the directly driven bearing lever 52 its plug 54 is moved outwardly forwardly and a pulling tensioning is produced in the connected spring wire 55. This generates on the second bearing lever 53 a moment which turns the bearing lever 53 and thereby the second belt clamping roller 57 also inwardly. Since the directly driven bearing lever 52 in the clamping position assumes a defined position, while the other bearing lever 53 is deviated more or less due to the spring force independence on the belt length and thickness, the spring wire 55 between the lever 52, 53 is angled so that a certain displacement between the engaging points is possible.

The bending angle and the wire length are selected so that despite the permissible displacement compensation, the driving operation of the spring wire 55 is not negatively affected. The application of the clamping force to the not directly actuated bearing lever 53 is performed through a torsion spring 59. This spring is held on a pin 60 on the transmission cover 57 and its one end 61 is supported against a formation 63 in the transmission cover 57 and pressed by it simultaneously against the transmission cover 57, so that the torsion spring 59 can not spring from the pin, while the other end 62 is supported on the axial 58 of the second clamping roller 47 and presses it thereby outwardly. Therefore, no additional components are needed for mounting of the spring 59.

Figure 9:
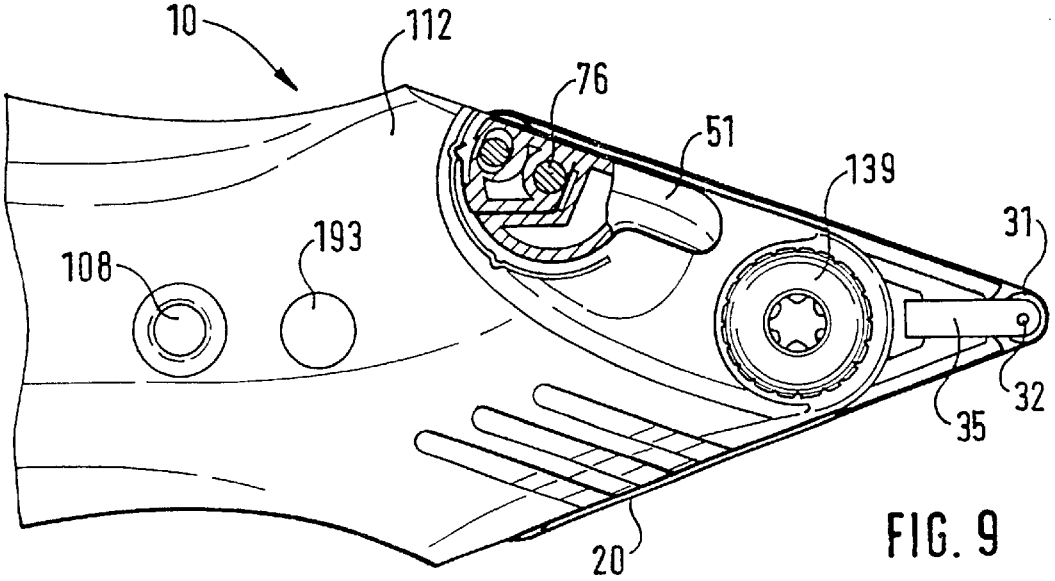
FIG. 9 is a view of a front region of the hand-held belt sander from the side of the clamping and loosening lever for sanding belt exchange.

The blocking of the clamping mechanism in the clamping position is performed through a U-shaped clamping spring 64 with two ears 65, 66 on its ends. One ear 66 surrounds the rotary axial of the directly actuated bearing lever 52, while the other ear 65 surrounds the extension of the axial 67 of the directly actuated clamping roller 48. The spring 64 is formed so that during the blocking process it slides with one corner on an inwardly projecting rib 68 of the housing 12 and therefore is deformed. At the end of the actuation path of the directly actuated bearing lever 52, the spring can snap under the rib 68 and thereby to block the mechanism against a reverse turning. The unblocking of the mechanism is performed by the clamping/releasing lever 51 which has an axial plug 69 engaging in the U-shaped spring 64. During the actuation of the releasing lever 51, first the blocking spring 64 is pressed by the plug 69 laterally, before the bearing lever 52 is turned. In order to prevent a direct co-rotation of the bearing lever 52 so that the forces on the bearing lever 52 do not unblock the blocking spring 64 by the clamping/releasing lever 51, the clamping/releasing lever is connected with a certain slack which is formed by an elongated hole 70 on the receptacle of the extension of the clamping roller axial 67. Thereby the mechanism can be unblocked by hand only by actuation of the lever 51. FIG. 9 shows a front region of the hand held belt sander 10 from the side of the longer shell 112. The turnable fork 35 of the handle 34 is supported at both sides on the concavely curved wall of the sliding shoe 33 which guides it as a supporting surface 39. One of the two neighboring deviating rollers 31 can be seen in the drawing. An especial bearing for the deviating roller 31 is dispensed with, since they are composed of a special, high-grade synthetic plastic and run without lubrication on the axial 32. The deviating rollers 31 can have a diameter of smaller than 8 mm. The pins 132 at the ends of the axial 32 engage in the openings of the fork 35. For mounting of the axial 32 in the fork 35, it is easily elastically bendable by an auxiliary tool manually. Subsequent, the axial 32 provided with the rollers 31 can be inserted. After this the fork 35 is compressed, the axial 32 is reliably clamped and is under slide pretensioning. The fork 35 acts simultaneously as a flat spring. Thereby the axial 32 and the rollers 31 can be exchanged with dismounting of the sliding shoe 33 or the hand held belt sander 10.

Figure 17A:
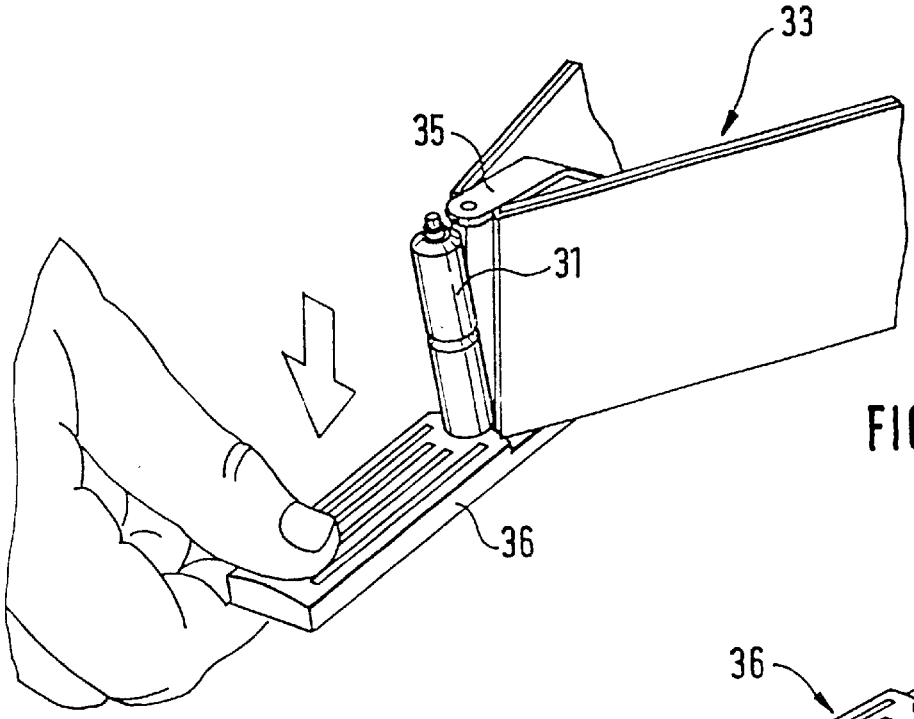
FIGS. 17*a* and 17*b* are views showing an auxiliary tool for exchanging deviating rollers.
Figure 17B:
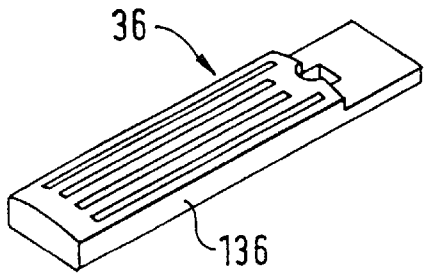

FIGS. 17*a* and 17*b* show the auxiliary tool 36 for easy exchange of the deviating rollers 31, for example in the case of wear. The tool 36 is an elongated, flat, synthetic plastic part which surrounds a side of the form 35. It is supported in an immediate proximity outside on the sliding shoe 33, runs with an engagement edge between the inner edge of the handle 35 and the end of the deviating roller 31, and over a long lever 136 a convenient elastic bending of the form 35 with only hand is performed. Thereby, the roller 31 and the axial 32 can be easily withdrawn and exchanged.

FIG. 11 shows that for both-side axial support of the axial 32, the handle 34 carries the fork 35 and is supported centrally with the opposite ends 37 in the sliding shoe 33. For fixing of its lateral position relative to the sliding shoe 33, the form 35 is curved inwardly concavely with the same curvature radius corresponding to that of the supporting surface 38 of the sliding shoe 33. The design of the fork 35 as a pretensioned flat spring permits the construction of the abutment surfaces 38 of the sliding shoe 33 so that the fork 35 during turning relative to the supporting surface 38 must be slightly bent and thereby spring against the abutment surface 38. Therefore, it sits without a gap in the sliding shoe 33. The tilting of the total handle 34 for the belt running centering is performed by means of an adjusting screw 39, manually with the rotary button 139. It engages with the rear end 37 of the handle 34 and its axis is approximately parallel to the axis 32 of the deviating rollers 31. The rear end 37 of the handle 34 is turnable by the adjusting screw 39, and it is fixable in all degrees. During adjustment the end 37 of the handle 34 slightly slides against the rear support 40 which is formed in the groove bottom of the slot 533. The radius 41 at the end 47 of the fork 35 is formed so that its central point is located in the virtual turning point 42 of the handle 34, which is identical with the center points of the radii of the supporting surface 38 in the slide shoe 33 over the fork 35. With another selection of the radius at the end 37 varying rotary points are provided during the adjustment.

For fixing the rotary point 42 no special axle is needed, in contrast to the known solution. Moreover, with the corresponding construction of the operational surfaces in the sliding shoe 33, no special guiding parts are needed for the handle 34.

The mounting of the handle 34 can be performed through the lateral opening 44 in the sliding shoe 33. Since a mounting from the front is dispensed with, the central and the rear end of the handle 34 can be designed substantially freely, since they have yet to be introduced through a small opening at the front end of the sliding shoe 33. This permits, for example, the angling of the plate, from which the handle 34 is produced to form a tab 235 with an opening 135 for passage of the adjusting screw 39. By expanding the fork during the mounting around the greater radii 38 in the sliding shoe 33, it is fixedly held in its position by the spring force. A tool for mounting or screwing or the like is not needed.

FIG. 11 shows how for producing the belt tensioning required for the operation of the hand-held belt center 10, the sanding belt 20 is guided over the two rollers 47, 48, in addition to the deviating rollers 31 and the driving roller 46. The rollers 47, 48 operate only for providing the tensioned guidance of the sanding belt 20.

Figure 12:
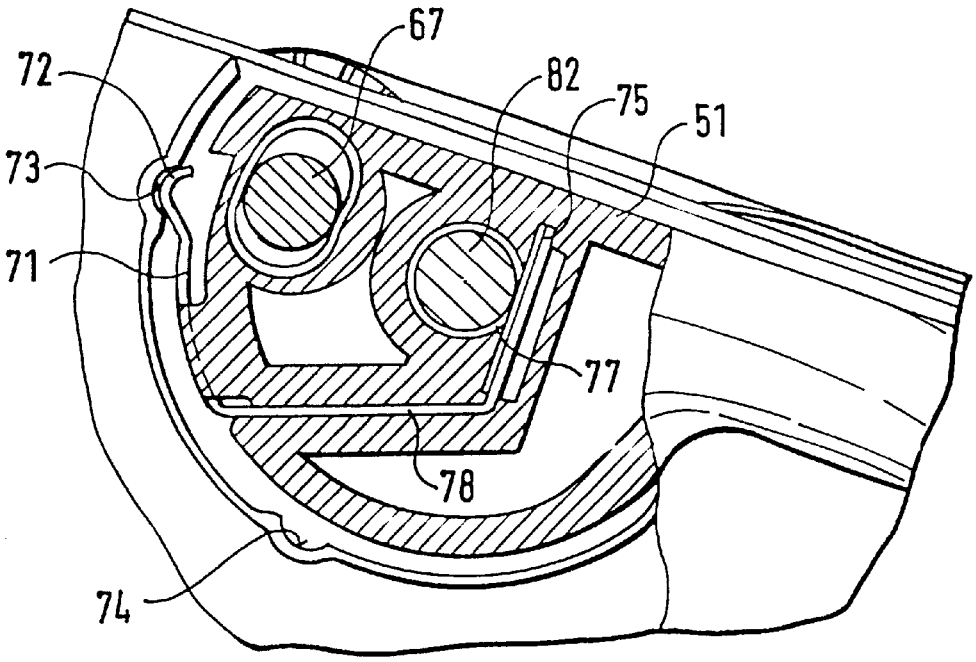
FIGS. 12, 13 are a longitudinal and a transverse section of the clamping and loosening lever.
Figure 13:
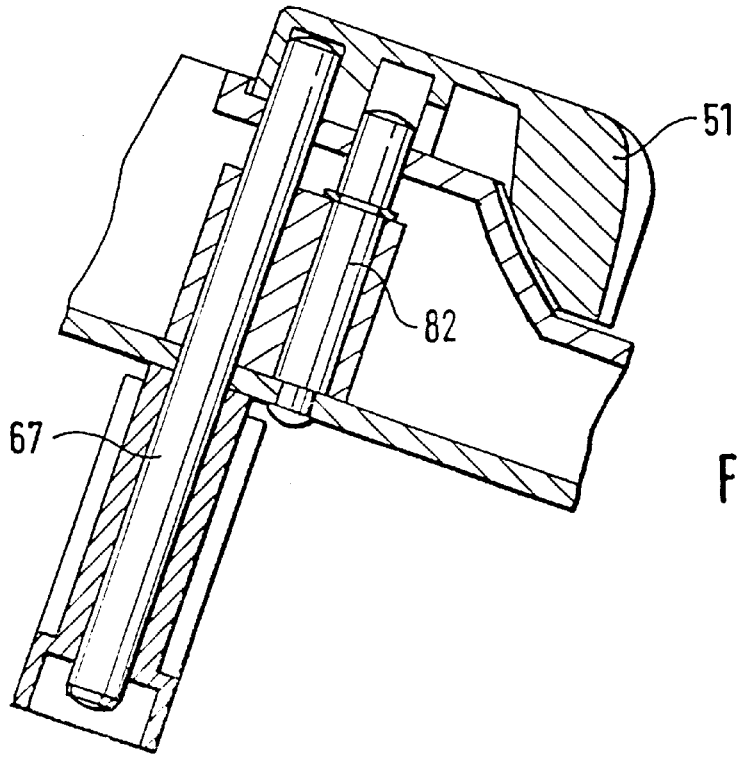

As can be seen from FIGS. 12, 13, the clamping/releasing lever 31 is composed of a synthetic plastic material. A multi-bent flat spring 31 is pressed in the synthetic plastic material and has two functions. One end 72 of the spring 71 which is formed as a projection and extends outwardly of the clamping/releasing lever engages in corresponding grooves 73, 74 in the housing 12, so that the lever 51 is arrestable in its both extreme positions. At the other end 75, the spring 71 carries a V-shaft elongated cortilugation which, after fitting the lever 51 on its rotary axle 82, engages in slot 77 of the axle 82. Thereby the lever 51 is secured in an axial direction against displacement. Additional mounting means for fixing the lever 51 on the axial 76 are not necessary. Thereby, the lever 51 can be inserted with flush edge in the housing contour so that it can not be lost but at the same time it is mounted so that it can be easily releasable.

For mounting the spring 71 in the clamping/releasing lever 51 it carries a further elongated cartugation 78. The elongated cartugation provides a press fit between the spring 71 and the lever 51 in the mounting groove. The belt clamping rollers 47, 48 are composed of synthetic plastic material and run directly slidingly on the steel axles 58, 67.

In order to prevent deposits of wear particles, sanding dust, etc. on the outer surface of the rollers, the rollers 47, 48 are not formed as smooth cylinders, but instead are provided with transverse groups 79, similarly to a toothed belt sprocket. The dust and wear particles can laterally move out through the transverse grooves. The remaining supporting surfaces of the rollers are to the contrary so small that the dust and the wear particles can not deposit there.

This makes possible clamping of the grinding band 20 on the hand-held belt sander 10 by two movable clamping rollers 47, 48, which together are actuated by the single clamping/releasing lever 51. The driving of the second varrying lever 53 is performed through the spring wire 55 while the pressing force of the second bearing lever 52 is provided through an additional torsion spring 59. The mechanism is connected through the U-shaped blocking spring 71 which blocks it in a clamped position. This blocking is removed by the plug 69 in the clamping/releasing lever 51 during its actuation. For this purpose, a definite slack is provided between the clamping/releasing lever and the bearing lever 52. A shaped flat spring 71 is pressed in the clamping lever and held through a cartigulation 78 in the clamping/releasing lever 51. A further cartigulation 75 arrests in the slot 77 the axle 76 of the clamping/releasing lever 51 and thereby secures its axial position. The spring 71 is provided on its free end with a projection 72. In the extreme positions of the clamping/releasing lever 51 it is arrested in the corresponding grooves 73, 74 of the housing 12 and thereby arrests the lever 51.

With the use of two clamping rollers 47, 48, instead of an adjustment of the deviating rollers 31 on the tip 333 of the sliding shoe 33 or the hand-held belt sander 10, constant belt running conditions at the tip can be provided. The reason is that it always remains in the same position and thereby the belt 20, independently from the belt tensioning runs always identically on the pressing surfaces 88, 89 or bases 133, 233 of the sliding shoe 33.

FIGS. 5–8 and 10 show how the total support of the belt clamping mechanism for the hand-held belt sander 10 is provided by the transmission cover 57. For this purpose two pins 77, 82 are riveted on the transmission cover 57 which is formed as a punched member. They operate as axles for both bearing levers 52, 53. Furthermore, the transmission cover 57 is connected through circular-arc-shaped punched portions 83, 84 operating for guiding and limiting the rotary movement of the bearing levers 52, 53. Also, it is mounted through a formation 63 under the clamping spring 59 of the clamping mechanism. Thereby the total clamping mechanism is premounted on the transmission cover 57.

For fixing the transmission cover 57 in the housing 12, it is provided with openings 85, so that housing plugs 90 engage in them during the mounting. During the mounting the transmission cover 57 is clamped between the sliding shoe 33 and the housing 12 and fixed in connection with the known positioning plugs 90. Therefore, no further mounting elements are needed.

The transmission cover 57, in addition to the receipt of the clamping mechanism, also performs other functions. A collar 86 produced by punching receives the needle bearing 87 for the drive shaft 91. The collar 86 serves simultaneously as a centering for a buffer disk of ceramic. It prevents a damage of the housing during a lateral running of the sanding belt 20 on the transmission cover 57 in the region of the driving roller 46. A further formation 88 prevents a turning of the buffer disk 92 which is flatened radially at one side. This flatening engages exactly into the above mentioned formation 88.

The axial securing of the buffer disk 92 performs during mounting by the sliding shoe 33 which for this purpose is provided with a special claw 89 which extends over the buffer disk 92. The sliding shoe 93 is centered by the dome 90 in the housing 12 and supported through the transmission cover 57 on the housing 12.

Figure 14A:
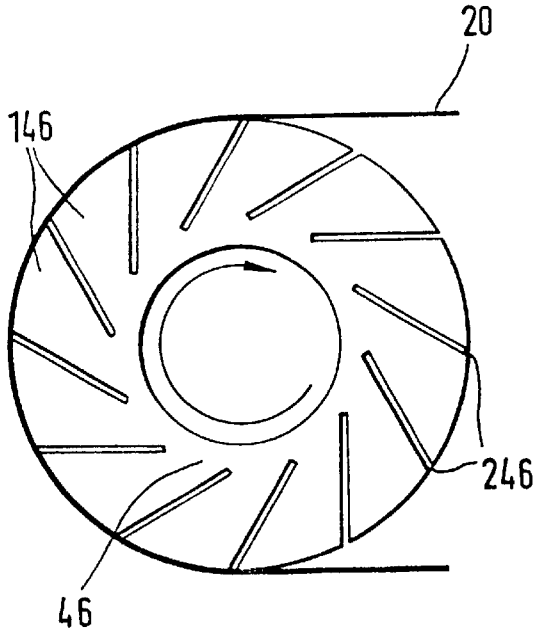
FIGS. 14*a* and 14*b* are views showing a transverse crosssection of the driving roller.
Figure 14B:
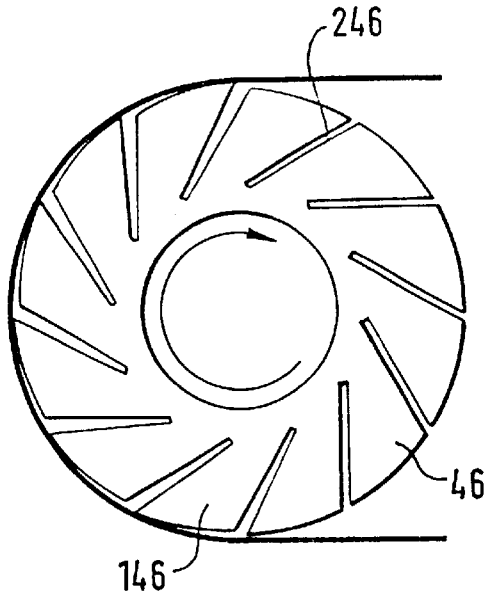

The cross-sections of the second example of the driving roller 36 shown in FIGS. 14*a*–14*b* have a specially defined peripheral region. With the use of a softer rubber mixture for the casing of the driving roller, a higher friction value is provided. With 2K tips a hard material is combined with soft strips to counteract the disadvantage that the rubber at high temperatures is soft, it deforms and wears out.

The driving roller 46 can sprinkled with a not shown grain material for example by glueing standard sanding agents. With this construction the friction value is also increased.

The arrangement of not shown wire brushes on a surface of the rollers composed of porous material also increases the friction value. Tearing-off of the brushes can be counteracted when the brushes are embedded in the material of the rollers so that only a short part extends outwardly the roller.

The casing of the driving roller 46 can be provided with inclined slots 246 to provide strip-like construction of the soft roller surface with strips 145. Thereby an increase surface pressure under load onto the sanding belt 20 is obtained, since the strips which are inclined in the running direction of the sanding belt 20 is obtained, since the strips which are inclined in the running direction of the sanding belt 20 are arranged under the driving force of the belt. The roller diameter of the driving roller 46 is increased and the belt tensioning is increased as well, which leads to higher transmittable force to the sanding belt 20. Furthermore, when the flattening is provided, a so-called polygon effect is achieved. The reason is that the sanding belt 20 with raised projection of the strips 146 no longer uniformly abuts against the whole surface of the roller, but instead runs only on the edges of the strips. As a result, a substantially higher surface pressure is provided.

Figure 15A:
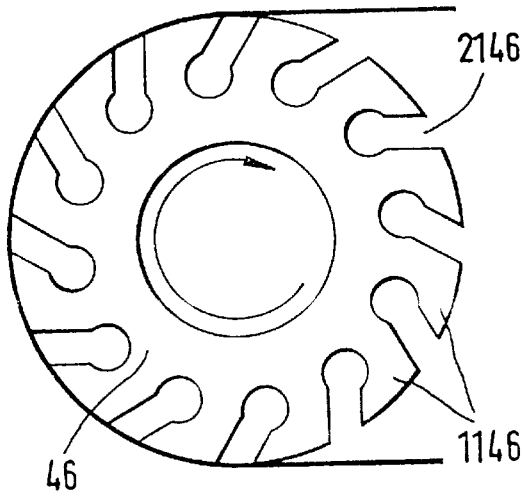
FIGS. 15*a* and 15*b* are views showing a further modification of the driving roller.
Figure 15B:
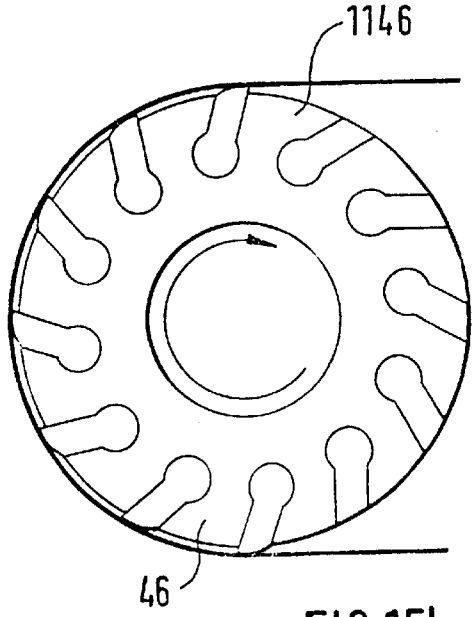
Figure 16:
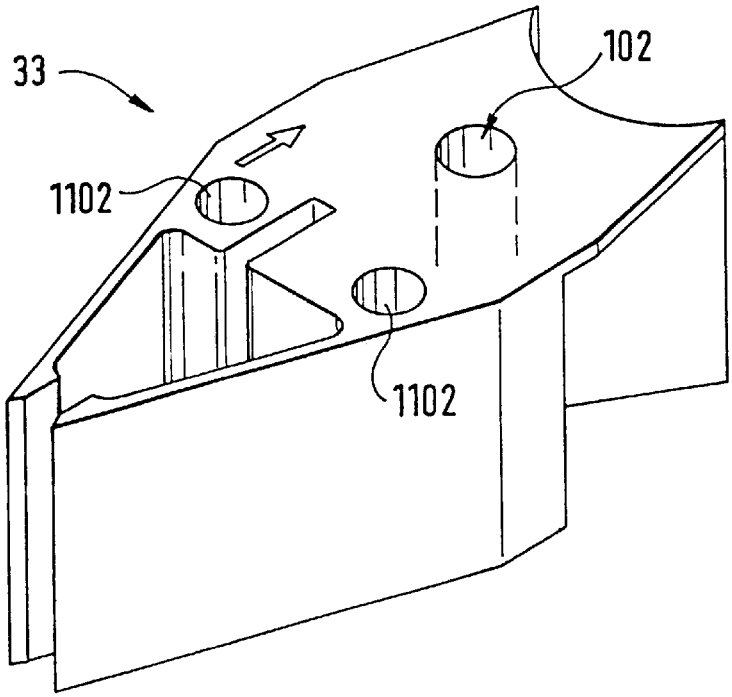
FIG. 16 is a spacial view of a sliding shoe.

In accordance with FIGS. 15*a*, 15*b*, 15*c*, similarly to a free running drive, the driving roller 46 is knotched so that six arresting elements can be pressed in the knotches 2146 connected by an undercut and produced for example by extrusion. The arresting members can be formed of metal or synthetic plastic material which raise underload. This arresting members in contrast to projections, are not deformable, so that the desired affect of the pressing force increase is provided here in stronger way.

In accordance with a not shown embodiment of the invention, the roller can be provided with a coating composed of brushes. Similarly to the fleece, the ruffle up during stroking against the nap.

In accordance with a further not shown embodiment of the invention, an additional pressing roller is provided. It presses the belt radially outwardly against the driving roller 46 so that the transmittable force or the embracing angle can be increased. If the pressing roller is composed of a sufficiently soft material, practically no wear occurs, as long as it runs on the sanding side of the belt.

In accordance with still a further not shown embodiment of the invention, the sanding belt is perforated, substantially as in a small film. The perforations can be arranged on the belt not only at the edge, but also in the center or at any other place. Radially outwardly extending pins of the driving roller engage in the perforations so as to provide a form-locking connection and therefore an optimal force transmission.

Finally, in accordance with still another embodiment of the invention, a profiled is applied to the inner side of the belt. For example, transverse grooves corresponding to a toothed belt can be provided, while the driving roller has a corresponding counter profile, so that also a form-locking connection between the sanding belt and the driving roller is produced.

It will be understood that each of the elements described above, or two or more together, may also find a useful application in other types of constructions differing from the types described above.

While the invention has been illustrated and described as embodied in hand-held belt sander, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A hand-held belt sander, comprising a housing; an on-off switch and a power supply conductor supported by said housing; a motor and a transmission received in said housing; a sanding belt; a driving roller driven by said motor and driving said sanding band; a sliding shoe provided with a base; a deviating roller arranged so that said sanding belt is guidable over said deviating roller and said base of said sliding shoe; means for centering said sanding band; means for clamping said sanding belt, said deviating roller and said driving roller have different diameters so that said sanding band is guided inclinedly, said housing being elongated and said sanding belt being guided on guiding parts which are introduced in a rear region of said elongated housing having a substantially uniform thickness, while in a front region of said elongated housing a centrally forwardly extending wedge-shaped contour is formed by upper and lower sides which converge starting from upper and lower sides of said rear region forwardly toward one another to a linear tip so that the hand-held belt sander as a whole has a lance-like contour with said elongated uniform-thickness rear region and said wedge-shaped tipped front region extending smoothly from both sides of said rear region.

2. A hand-held belt sander as defined in claim 1, wherein said guiding parts are formed by said deviating roller and said sliding shoe.

3. A hand-held belt sander as defined in claim 1, wherein said guiding parts have wedge surfaces which are symmetrical relative to a longitudinal axis of said housing.

4. A hand-held belt sander as defined in claim 1, wherein said sanding belt has two edges, one of said edges projecting outwardly beyond said housing for edge-flush works.

5. A hand-held belt sander as defined in claim 1, and further comprising a transmission cover; and two band tensioning rollers arranged near said driving roller substantially parallel to said driving roller and at a radial distance from the latter, said band tensioning rollers being supported on said transmission covers springy relative to said sanding belt.

6. A hand-held belt sander as defined in claim 5, wherein said housing has a longer shell and a shorter shell; and further comprising a clamping and releasing lever turnably arranged on said longer shell and pullable into its outer contour, said housing directly above said clamping and releasing lever having an inclinedly arranged depression, so that when a finger is pressed on said clamping and releasing lever, it is guided inclinedly on a housing wall downwardly in a sliding fashion and therefore said clamping and releasing lever is easily actuatable.

7. A hand-held belt sander as defined in claim 1, wherein said means for clamping said sanding belt include a handle with a fork which supports said deviating roller adjustable by an adjusting screw for belt running centering, said housing having a longer shell and a shorter shell; and further comprising a transmission cover, said sliding shoe forming one of said guiding parts and being formed as a one-piece wedge-shaped member and supporting said handle with said fork, said sliding shoe being mountable on said longer shell so that it presses said transmission cover against said longer shell in a region of connection of said shells.

8. A hand-held belt sander as defined in claim 7, wherein said one-piece wedge-shaped member which forms said sliding shoe is composed of magnesium.

9. A hand-held belt sander as defined in claim 7; and further comprising an adjusting button provided for said adjusting screw and arranged laterally on a front end of said longer shell near said clamping and releasing lever so as to extend outwardly and drawable into a contour of said longer shell.

10. A hand-held belt sander as defined in claim 1; and further comprising a transmission cover, said housing being formed as a machine an angular transmission housing, said housing being composed of housing shells which are formed of synthetic plastic material and sealing reinforced by said transmission housing.

11. A hand-held belt sander as defined in claim 7, and further comprising a further shoe which has a supporting surface for said fork, said supporting surface being concavely curved about a rotary point of said handle.

12. A hand-held belt sander as defined in claim 7, wherein said handle is spring-elastically holdable in a neutral position; and further comprising an adjusting screw and a rotary knob actuating said adjusting screw for adjusting said handle.

13. A hand-held belt sander, comprising a housing; an on-off switch and a power supply conduit supported by said housing; a motor and a transmission accommodated in said housing; a sanding belt; a drive rotatably driven by said motor and rotatably driving said sanding belt; a deviating roller; and a sliding shoe having a base and a working surface, said sanding belt being guided by said deviating roller and by said sliding shoe and pressed by said working surface against the workpiece; means for belt running centering; means for belt clamping, said housing having an elongated lance-shaped forwardly wedge contour, said driving and deviating rollers being arranged so that they are substantially coincide with a longitudinal axis of said housing, said housing having a rear region which is formed as a handle for two-hand operation.

14. A hand-held belt sander as defined in claim 13, wherein said housing is composed of two shells which are joined together along a butt joint.

15. A hand-held belt sander as defined in claim 14, wherein said shells are asymmetrical relative to one another both transversely and longitudinally, and said butt joint alternatingly extends outside and inside of said shells.

16. A hand-held belt sander as defined in claim 14, wherein said shells include a longer shell and a shorter shell which amountable with one another so that in a front region of said housing a recess is formed, in which on said longer shell said deviating roller and said driving roller are arranged with said sanding belt.

17. A hand-held belt sander as defined in claim 16, wherein said sanding belt having a fork-shaped end which engages with said shorter shell.

18. A hand-held belt sander as defined in claim 16, wherein said driving roller engages with said shorter shell at a front end.

19. A hand-held belt sander as defined in claim 13, and further comprising parts which guide said sanding belt and include said driving roller and said deviating roller, said guiding parts being arranged inside a contour of said housing in a wedge-shaped region of said housing, said deviating roller and said driving roller extending parallel to one another and transversely to an axis of said housing.

20. A hand-held belt sander as defined in claim 16, and further comprising a transmission cover, said deviating roller and said clamping cover are being premountable on said transmission cover as an intermediate support, said transmission cover forming in a plane of separation of said housing a wall formed as a sheet metal cover so as to close inwardly said depression between said shells.

21. A hand-held belt sander as defined in claim 13, wherein said housing is composed of a longer shell and a shorter shell, said longer shell having a contour which is formed as a wedge-shaped tip following a radially outwardly expanding region, said shorter shell having a contour substantially corresponding to said contour of said longer shell until an outwardly expanding region and is curved there in a U-shaped manner so as to be drawn rearwardly.

22. A hand-held belt sander as defined in claim 21, wherein said outwardly expanding region of said shorter shell engages said sanding belt in a region of said driving roller to form a contact and dust protection, said shorter housing shell forwardly at an outer end of said outwardly expanding region at its one side being provided with an aspiration opening extending over a width of said shorter shell and communicating with a dust aspiration passage.

23. A hand-held belt sander as defined in claim 22, wherein said shorter shell has a suction pipe at a rear region, said dust aspiration passage having a central region which is formed as a flat passage and extends in both said shells.

* * * * *